US006536339B2

(12) United States Patent
Negishi

(10) Patent No.: US 6,536,339 B2
(45) Date of Patent: Mar. 25, 2003

(54) STENCIL PRINTER SYSTEM

(75) Inventor: Hideo Negishi, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/842,171

(22) Filed: Apr. 26, 2001

(65) Prior Publication Data

US 2001/0037736 A1 Nov. 8, 2001

(30) Foreign Application Priority Data

Apr. 26, 2000 (JP) ..... 2000/125503

(51) Int. Cl.[7] ..... B41C 1/14
(52) U.S. Cl. ..... 101/128.4; 101/116
(58) Field of Search ..... 101/128.4, 115, 101/116, 228

(56) References Cited

U.S. PATENT DOCUMENTS 5,438,347 A * 8/1995 Shishido et al. ..... 101/114
6,250,220 B1 * 6/2001 Sainio et al. ..... 101/228

FOREIGN PATENT DOCUMENTS

JP B2 2538817 7/1996

* cited by examiner

*Primary Examiner*—Ren Yan
(74) *Attorney, Agent, or Firm*—Nixon Peabody LLP; Donald R. Studebaker

(57) ABSTRACT

In a stencil printer system, a stencil is made by the use of master material unrolled from a stencil material roll and is wound around a printing drum by clamping the leading end of the stencil on the printing drum and rotating the printing drum while the stencil is once slackened on the way to the printing drum. There is provided along the stencil conveyance path between the stencil material roll and the printing drum a tension blade which is pressed against the stencil to apply back tension to the stencil when the stencil is run by the printing drum and the tension blade is formed so that the stencil undergoes force which tends to displace outward the stencil from the central portion in the direction of width of the stencil.

4 Claims, 3 Drawing Sheets

STENCIL PRINTER SYSTEM

BACKGROUND OF THE INVENTION

1. Field of the Invention

This invention relates to a stencil printer system provided with a stencil making section, and more particularly to an improved structure for applying a back tension to the stencil material when a stencil made by the stencil making section is wound around the printing drum.

2. Description of the Related Art

There has been known a stencil printer system with a stencil making section. In such a stencil printer system, there has been known a technique in which, in order to associate stencil making with winding the stencil around the printing drum, a stencil conveyor roller and a stencil discharge roller are provided downstream of the stencil making section. When a stencil is being made, the conveyor roller is driven while the discharge roller is stopped, whereby the stencil is held slackened between the stencil conveyor roller and the stencil discharge roller until the stencil is finished. After the stencil is finished, the printing drum is rotated with the leading end of the stencil clamped by a clamper on the printing drum while the stencil discharge roller is driven by the printing drum by way of the stencil applying a tension to the stencil by means of a one-way clutch built in the stencil discharge roller. See, for instance, Japanese Patent No. 2538817.

When winding the stencil around the printing drum, it is important to apply a stable back tension to the stencil in order to properly winding the stencil around the printing drum. However, when the back tension is applied to the stencil only by driving the stencil discharge roller by way of the stencil as in the prior art, the back tension applied to the stencil cannot be stabilized.

That is, in the state after the stencil is made and before it is wound around the printing drum, the stencil is held slackened between the stencil conveyor roller and the stencil discharge roller and the stencil discharge roller is small in diameter and in a line contact with the stencil. Accordingly, until the stencil charge roller starts to be rotated pulled by the stencil, a certain back tension can be applied to the stencil. However, after the stencil discharge roller once starts rotating, the tension applied to the stencil fluctuates with rotation of the stencil discharge roller.

This problem may be overcome by providing a tension blade which is pressed against the stencil on the stencil conveyance path between the stencil material roll and the printing drum.

However, when such a tension blade is not accurately positioned with respect to the stencil, the expected result cannot be obtained. That is, in order to apply a desired back tension to the stencil in a predetermined tension distribution in the transverse direction of the stencil, it is required that the shape of the tension blade and the tension blade mounting accuracy are high in all the directions, which makes it very difficult to realize this method of applying a proper back tension to the stencil.

For example, when the tension blade is obliquely pressed against the stencil, the stencil runs obliquely, whereby the stencil can be wrinkled or the stencil cannot be wound around the printing drum in the regular position, which can result in unsatisfactory printings. Further, when the tension blade is not pressed against the stencil at a uniform pressure, the stencil undergoes force which tends to displace the stencil toward a position and wrinkle the stencil.

A tension blade high in dimensional accuracy is difficult to manufacture and to mount the tension blade with high mounting accuracy requires accurate alignment in all the directions, which makes troublesome the maintenance of the printer system.

SUMMARY OF THE INVENTION

In view of the foregoing observations and description, the primary object of the present invention is to provide a stencil printer system in which the stencil can be accurately wound around the printing drum in a desired position without fear that the stencil is obliquely wound around the printing drum or the stencil is wrinkled and at the same time, the requirements of the dimensional accuracy and the mounting accuracy of the tension blade are relaxed.

In accordance with the present invention, there is provided a stencil printer system in which a stencil is made by the use of master material unrolled from a stencil material roll and is wound around a printing drum by clamping the leading end of the stencil on the printing drum and rotating the printing drum while the stencil is once slackened on the way to the printing drum, wherein the improvement comprises that there is provided along the stencil conveyance path between the stencil material roll and the printing drum a tension blade which is pressed against the stencil to apply back tension to the stencil when the stencil is run by the printing drum and the tension blade is formed so that the stencil undergoes force which tends to displace outward the stencil from the central portion in the direction of width of the stencil.

For example, the tension blade may be formed so that the stencil undergoes force which tends to displace outward the stencil from the central portion in the direction of width of the stencil by forming grooves on the surface of the tension blade to be brought into contact with the stencil so that the contact area of the tension blade with the stencil is smaller at the outer portion than at the central portion of the stencil. In this case, it is preferred that the grooves be formed so that the contact area of the tension blade with the stencil becomes gradually smaller toward the outer portion from the central portion of the stencil.

Further, the tension blade may be formed so that the stencil undergoes force which tends to displace outward the stencil from the central portion in the direction of width of the stencil by forming grooves on the surface of the tension blade to be brought into contact with the stencil to extend obliquely outward forward of the direction of conveyance of the stencil. In this case, the grooves may be formed so that the contact area of the tension blade with the stencil is smaller at the outer portion than at the central portion of the stencil.

It is preferred that the tension blade be symmetrical with respect to the longitudinal axis of the stencil.

In accordance with the present invention, since back tension is applied to the stencil so that the stencil undergoes force which tends to displace outward the stencil from the central portion in the direction of width of the stencil, back tension can be stably applied to the stencil without fear that the stencil is obliquely wound around the printing drum or the stencil is wrinkled. At the same time, the requirements of the dimensional accuracy and the mounting accuracy of the tension blade are relaxed, whereby manufacture and mounting of the tension blade are facilitated, which is advantageous from the viewpoints of cost and maintenance. These advantages are not lost by change with time of the tension blade.

When tension blade is formed with grooves on the surface of the tension blade to be brought into contact with the stencil so that the contact area of the tension blade with the stencil is smaller at the outer portion than at the central portion of the stencil and/or so that the grooves extend obliquely outward forward of the direction of conveyance of the stencil, force which tends to spread outward the stencil acts on the stencil as the stencil is run, whereby longitudinal wrinkle parallel to the direction of conveyance of the stencil is prevented from being generated and the back tension applied to the stencil is stabilized.

DESCRIPTION OF THE PREFERRED EMBODIMENTS

Figure 1:
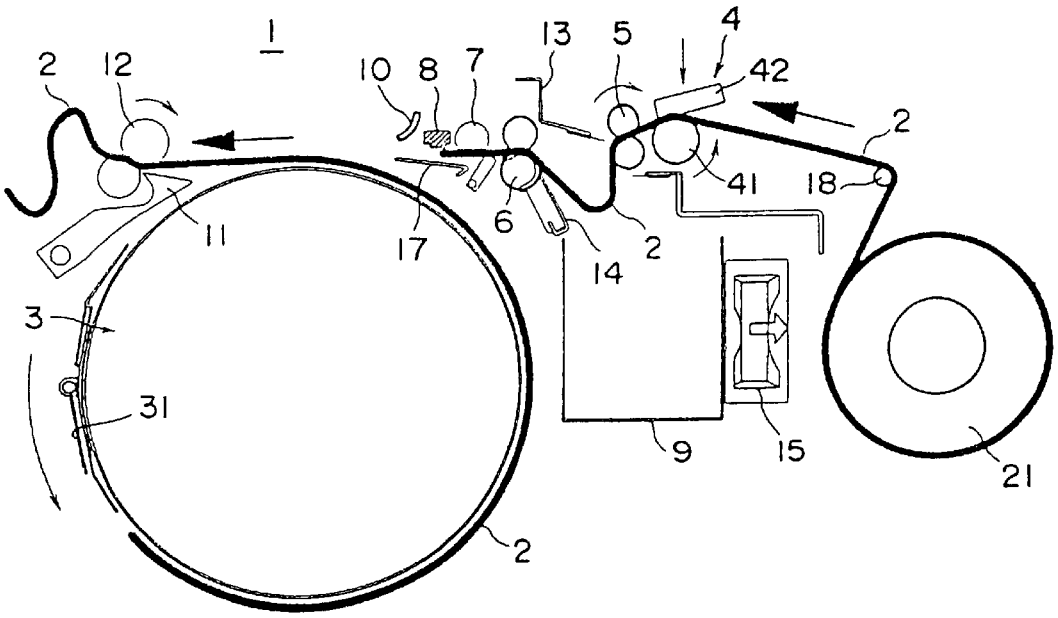
FIG. 1 is a schematic view showing a stencil printer system in accordance with a first a embodiment of the present invention in a state where a stencil is just started to be made.

In FIG. 1, a stencil printer system 1 in accordance with an embodiment of the present invention comprises a printing drum 3 around which a stencil 2 is wound. The stencil 2 is made by perforating a stencil material in a continuous length and cutting the perforated stencil material in a predetermined length. In this specification, the term "stencil" sometimes denotes the stencil cut from the stencil material in a continuous length and sometimes denotes the stencil material. Though not shown, an ink roller adapted to be brought into abutment against the inner peripheral surface of the printing drum 3 is disposed inside the printing drum 3 and a press roller which presses printing sheets against the outer peripheral surface of the printing drum 3 is disposed outside the printing drum 3. Ink supplied to the ink roller from an ink container (not shown) is transferred to the printing sheet through the perforations of the stencil 2, whereby printing is made.

A clamping plate 31 is mounted on the outer peripheral surface of the printing drum 3 for rotation between its clamping position where it is pressed against the outer peripheral surface of the printing drum 3 with a leading end portion of the stencil 2 intervening therebetween, thereby fixing the leading end portion of the stencil 2 to the printing drum and its releasing position where it is away from the outer peripheral surface of the printing drum 3 and releases the stencil 2. Further a separator member 11 which peels the stencil 2 from the printing drum 3 and a pair of stencil discharge rollers 12 which convey the peeled stencil 2 to a stencil discharge section (not shown) are disposed outside the printing drum 3.

A stencil making section 4 which imagewise perforates the stencil material unrolled from a stencil material roll 21 and makes a stencil 2 is disposed on the side of the printing drum 3 opposite to the stencil discharge rollers 12. The stencil material roll 21 is supported for rotation on a roll holder (not shown).

Along the stencil conveyance path from the stencil material roll 21 to the printing drum 3, a platen roller 41, a pair of stencil conveyor rollers 5 a pair of stencil discharge rollers 6, a cutter 7, a waiting sensor 8 and a tension blade 10 are provided in this order.

Further a thermal head 42 is provided to be movable up and down toward and away from the platen roller 41. That is, since the stencil material 2 is conveyed along the upper surface of the platen roller 41, the thermal head 42 is moved into contact with the stencil material 2 and away from the same, whereby imagewise perforates the stencil material 2 and makes a stencil. The platen roller 41 conveys the stencil 2 at a speed conforming to the stencil making speed of the thermal head 42.

The upper and lower stencil conveyor rollers 5 disposed near to the platen roller 41 conveys the stencil 2 at the same speed as the platen roller 41 and is driven in association with the platen roller 41. The lower stencil conveyor roller 5 is a driving roller and the upper roller 5 is a driven roller and is pressed against the lower roller under its gravity. The upper and lower stencil discharge rollers 6 which are disposed at a distance from the stencil conveyor rollers 5 are able to be rotated in the regular direction and the reverse direction independently of the other rollers. The lower stencil discharge roller 6 is a driving roller and the upper roller 6 is a driven roller and is moved up and down away from and into contact with the lower roller 6 by an up-and-down mechanism (not shown).

Figure 2:
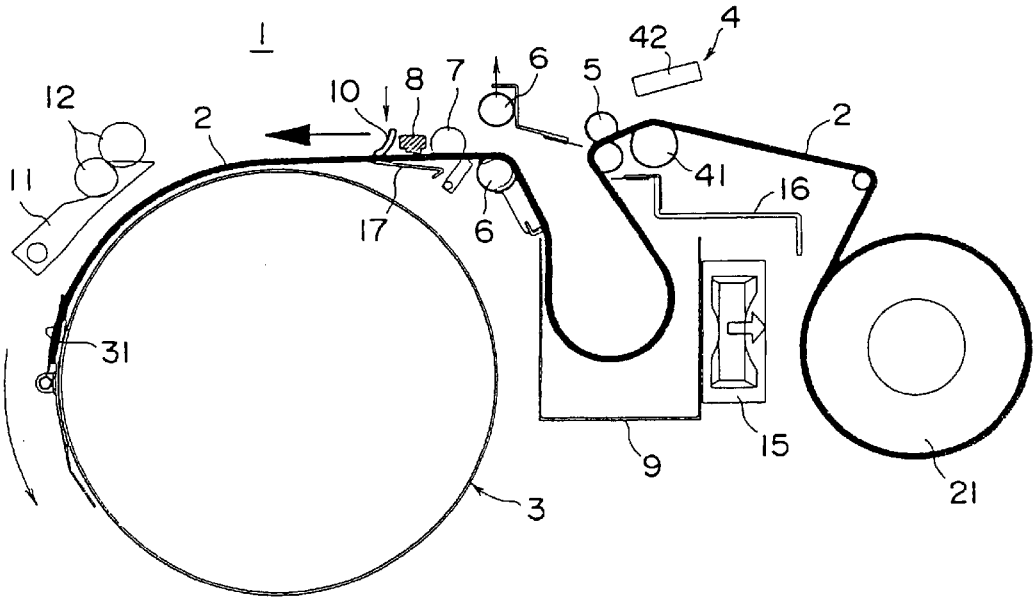
FIG. 2 is a view similar to FIG. 1 but showing the stencil printer system in a state where a stencil is just started to be wound around the printing drum.

The stencil conveyor rollers 5 are arranged to be rotatable, when the lower roller 6 is not driven, pulled by the stencil 2 when the printing drum 3 is rotated with the leading end portion of the stencil 2 held by the clamping plate 31. When the stencil 2 is run by the printing drum 3, the upper stencil discharge roller 6 is held upward away the stencil 2 so that no load is applied to the stencil 2 as shown in FIG. 2.

Between the stencil conveyor rollers 5 and the stencil discharge rollers 6, there is provided a stencil storing box 9 open upward. A pressing plate 13 with a static eliminator brush is provided above the stencil storing box 9. A guide plate 14 inclined toward the stencil storing box 9 is provided below the stencil discharge rollers 6. A suction fan 15 is provided for the stencil storing box 9, and a cover 16 is provided between the suction fan 15 and the stencil making section 4.

The cutter 7 comprises an upper rotary blade and a lower bearing blade and cuts the stencil 2 in the direction transverse to the direction of conveyance of the stencil 2. The waiting sensor 8 is for detecting passing of the stencil 2 and may comprise a transmissive or reflective optical sensor. A plate member 17 which supports the lower side of the stencil 2 is provided opposed to the waiting sensor 8.

The tension blade 10 is supported for up and down movement toward and away form the plate member 17 between an operative position where a curved surface thereof is brought into contact with the stencil 2 to press the stencil 2 against the plate member 17 and a retracted position where it is away from the stencil 2. As will be described in more detail later, the curved surface of the tension blade 10 is formed so that a back tension is applied to the stencil 2 by frictional resistance and the stencil 2 undergoes force which tends to displace the stencil 2 from the central portion in the direction of width of the stencil 2 toward the side edges of the stencil 2.

The stencil material 2 unrolled from the stencil material roll 21 is fed to the stencil making section 4 by way of a guide member 18 which bends the stencil material 2 in a direction opposite to the direction in which the stencil material roll 21 is rolled.

Though not shown, the stencil printer system of this embodiment is provided with a control unit. The control unit controls the thermal head 42, the platen roller 41, the conveyor rollers 5, the discharge rollers 6, the cutter 7, the tension blade 10, the printing drum 3, the separator member 11, the stencil discharge rollers 12 on the basis of signals output from the waiting sensor 8 and other sensors.

Figure 3A:
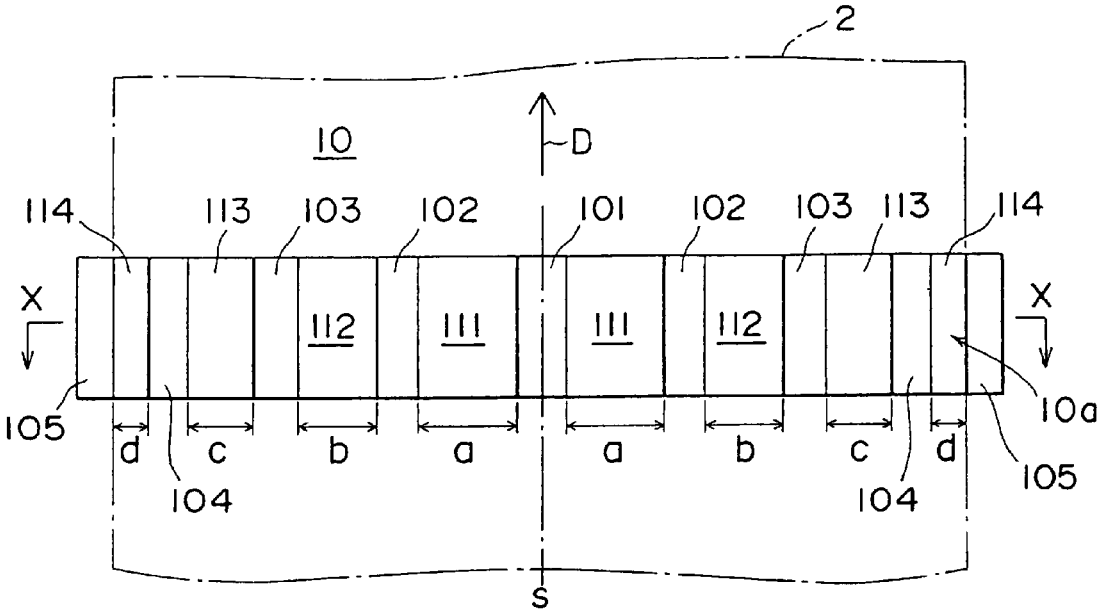
FIG. 3A is a bottom view of an example of the tension blade.
Figure 3B:
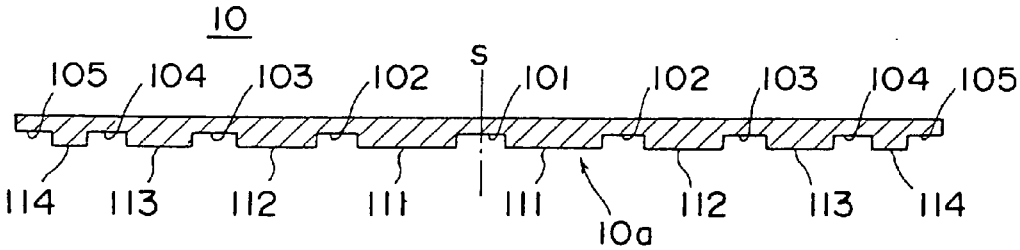
FIG. 3B is a cross-sectional view taken along line X—X in FIG. 3A.
Figure 3C:
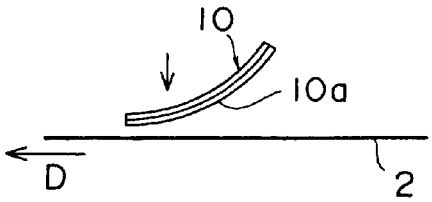
FIG. 3C is a side view of the tension blade shown in FIG. 3A.

As shown in FIGS. 3A to 3C, the tension blade 10 extends in the transverse direction of the stencil 2 and is arcuated as seen from a side. The downstream side end portion of the outer surface 10*a* of the tension blade 10 is brought into contact with the stencil 2. In FIGS. 3A and 3C, the direction of conveyance of the stencil 2 is denoted by D. The outer surface 10*a* of the tension blade 10 at which the tension blade 10 is brought into contact with the stencil 2 is provided with a plurality of grooves 101 to 105 in parallel to the direction D of conveyance of the stencil 2 so that the contact area of the tension blade 10 with the stencil 2 becomes gradually smaller toward the outer portion from the central portion of the stencil 2. The grooves 101 to 105 are formed symmetrically with respect to the longitudinal axis s of the stencil 2.

More specifically, the central groove 101 is formed at the center of the tension blade 10 so that the center line of the central groove 101 conforms to the longitudinal axis s of the stencil 2 and three grooves 102 to 104 substantially of the same width are formed on each side of the central groove 101 so that the spaces therebetween are gradually narrowed outward. An edge groove 105 is formed outside the groove 104. That is, contact lands 111 to 114 are formed between the grooves 101 to 105 and the widths a to d of the contact lands 111 to 114 become smaller in this order. (a>b>c>d)

When the tension blade 10 with this arrangement is brought into contact with the stencil 2, the contact resistance is maximum at the center of the stencil and becomes smaller toward the outer edges of the stencil 2. As a result, the central portion of the stencil 2 is expanded and the stencil 2 undergoes force which tends to displace the stencil 2 from the central portion toward the side edges of the stencil 2, whereby slack, which can result in longitudinal wrinkle of the stencil 2, cannot be generated in the central portion. Further, since the shape of the contact surface 10*a* of the tension blade 10 is symmetrical, the stencil 2 is not obliquely run and accordingly, the stencil 2 can be evenly wound around the printing drum 3 in a correct position.

The stencil making and the stencil mounting in the stencil printer system 1 will be described, hereinbelow. In the waiting state where the stencil printer system 1 is waiting to make a next stencil, the preceding stencil 2 has been on the printing drum 3 and printing by the preceding stencil 2 has been finished. In this state, the rollers 41, 5 and 6 have been stopped in the positions where the leading end of the stencil master 2 is detected by the waiting sensor 8.

As shown in FIG. 1, when the next stencil 2 is started to be made, the thermal head 42 is moved downward to press the stencil material 2 against the platen roller 41, and as the thermal head 42 starts perforating the stencil material 2, the platen roller 41 and the conveyor rollers 5 are rotated in the regular direction to convey the stencil material 2 at a speed conforming to the stencil making speed of the thermal head 42, whereas the discharge rollers 6 are stopped with the leading end of the stencil master 2 nipped therebetween. As a result, the stencil material 2 is fed out of the conveyor rollers 5 in a length larger than the distance between the rollers 5 and 6, whereby the stencil material 2 is slackened between the rollers 5 and 6 and the slack is introduced into the stencil storing box 9 by the pressing plate 13 above the stencil storing box 9. As the stencil making progresses, the length of slack is increased. In response to starting the stencil making, the clamping plate 31 is rotated to its releasing position and releases the preceding stencil 2. Thereafter the separator member 11 peels the stencil 2 from the printing drum 3 and the stencil discharge rollers 12 convey the peeled stencil 2 to the stencil discharge section.

When the next stencil 2 is finished, the thermal head 42 is moved upward away from the stencil 2, and at the same time, the platen roller 41 and the conveyor rollers 5 are stopped. Then the discharge rollers 6 are rotated in the regular direction and feed the leading end of the stencil 2 to the clamping plate 31. At this time, the tension blade 10 is in the upward position away from the stencil 2. When the leading end of the stencil 2 reaches a predetermined clamping position, the discharge rollers 6 are stopped, and the clamping plate 31 is rotated to its clamping position to fix the leading end of the stencil 2 to the printing drum 3.

Then as shown in FIG. 2, the upper discharge roller 6 is moved upward away from the stencil 2 and the tension blade 10 is moved downward to the operative position where the outer surface 10*a* is pressed against the stencil 2 so that frictional resistance acts on the stencil 2. In this state, the printing drum 3 is rotated in the direction of the arrow in FIG. 2, whereby the stencil 2 is wound around the printing drum 3. At this time, the tension blade 10 applies a back tension to the stencil 2 in such a manner that the stencil 2 undergoes force which tends to displace the stencil 2 from the central portion in the direction of width of the stencil 2 toward the side edges of the stencil 2 symmetrically with respect to the longitudinal axis of the stencil 2. The conveyor rollers 5 and the platen roller 41 are held stopped. After the slack of the stencil 2 is cancelled, the stencil material roll 21 is rotated pulled by the stencil material 2 and the conveyor rollers 5 are also rotated pulled by the stencil material 2.

When the printing drum 3 is rotated to a predetermined position and the stencil 2 is fed by a predetermined length, the cutter 7 is operated and the stencil 2 is cut. Even after the stencil 2 is cut from the stencil material roll 21, the tension blade 10 keeps applying back tension to the stencil 2 since the tension blade 10 is positioned nearer to the printing drum 3 than the cutter 7, whereby thestencil 2 is not run obliquely and can be evenly wound around the printing drum 3 in a correct position. In response to the cutter 7 cutting the stencil 2, the upper discharge roller 6 is moved downward to hold the cut end of the stencil material 2 together with the lower discharge roller 6.

The printing drum 3 is further rotated to wind therearound the full stencil 2 and then stopped. Thereafter, the tension blade 10 is returned to the retracted position, while the thermal head 42 is moved downward and the platen roller 41, the conveyor rollers 5 and the discharge rollers 6 are rotated in the regular direction at the same speed, thereby unrolling the stencil material 2 from the roll 21. When the leading end of the stencil material 2 is detected by the waiting sensor 8, the platen roller 41, the conveyor rollers 5 and the discharge rollers 6 are stopped and the thermal head 42 is moved upward. This state is a waiting state.

In the stencil printer system 1 of this embodiment, the stencil 2 is not obliquely run and accordingly, the stencil 2 can be evenly wound around the printing drum 3 in a correct position without being wrinkled by virtue of the tension blade 10 which is pressed against the stencil 2 to apply back tension to the stencil 2 in such a manner that the stencil 2 undergoes force which tends to symmetrically displace the stencil 2 from the central portion in the direction of width of the stencil 2 toward the side edges of the stencil 2. Further, in this particular embodiment, since the stencil 2 is released from the discharge rollers 6 when the stencil 2 is wound around the printing drum 3 so that the discharge rollers 6 apply no load to the stencil 2, fluctuation in load on the stencil 2 generated when the discharge rollers 6 are driven pulled by the stencil 2 can be suppressed.

Figure 4A:
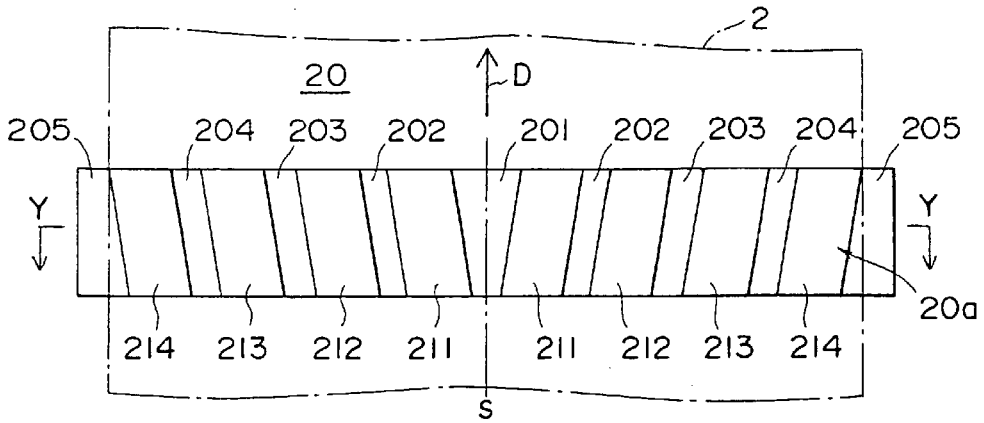
FIG. 4A is a bottom view of another example of the tension blade.
Figure 4B:
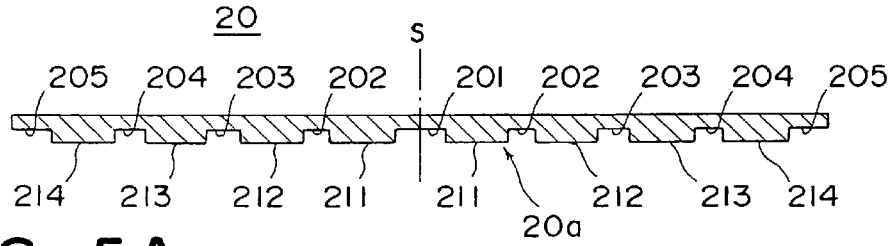
FIG. 4B is a cross-sectional view taken along line Y—Y in FIG. 4A.

Another example of the tension blade 10 will be described with reference to FIGS. 4A and 4B, hereinbelow.

The tension blade 20 of this example differs from the tension blade 10 shown in FIGS. 3A and 3B in the shape and arrangement of the grooves formed on the outer surface 20*a* at which the tension blade 20 is brought into contact with the stencil 2.

That is, in this example, the central groove 201 is formed at the center of the tension blade 20 so that the center line of the central groove 201 conforms to the longitudinal axis s of the stencil 2 and three grooves 202 to 204 substantially of the same width are formed on each side of the central groove 201. The central groove 201 is of a trapezoid in shape flaring toward the downstream of the direction of conveyance of the stencil 2, and the grooves 202 to 204 extend obliquely outward toward the downstream of the direction of conveyance of the stencil 2 at a predetermined angle to the direction of conveyance inparallel to each other. Further, an edge groove 205 is formed outside the groove 204 with the inner edge thereof extending in parallel to the grooves 202 to 204. That is, parallelogrammical contact lands 211 to 214 of substantially the same area are formed between the grooves 201 to 205.

When the tension blade 20 with this arrangement is brought into contact with the stencil 2, the contact points between the tension blade 20 and the stencil 2 are shifted from the central portion toward the side edges of the stencil in parallel to the direction of the grooves 202 to 205 as the stencil 2 slides on the tension blade 20 in the direction D of conveyance of the stencil 2, whereby outward frictional resistance acts on the stencil 2. As a result, the central portion of the stencil 2 is expanded and the stencil 2 undergoes force which tends to displace the stencil 2 from the central portion toward the side edges of the stencil 2, whereby slack, which can result in longitudinal wrinkle of the stencil 2, cannot be generated in the central portion. Further, since the shape of the contact surface 10*a* of the tension blade 10 is symmetrical, the stencil 2 is not obliquely run and accordingly, the stencil 2 can be evenly wound around the printing drum 3 in a correct position.

Figure 5A:
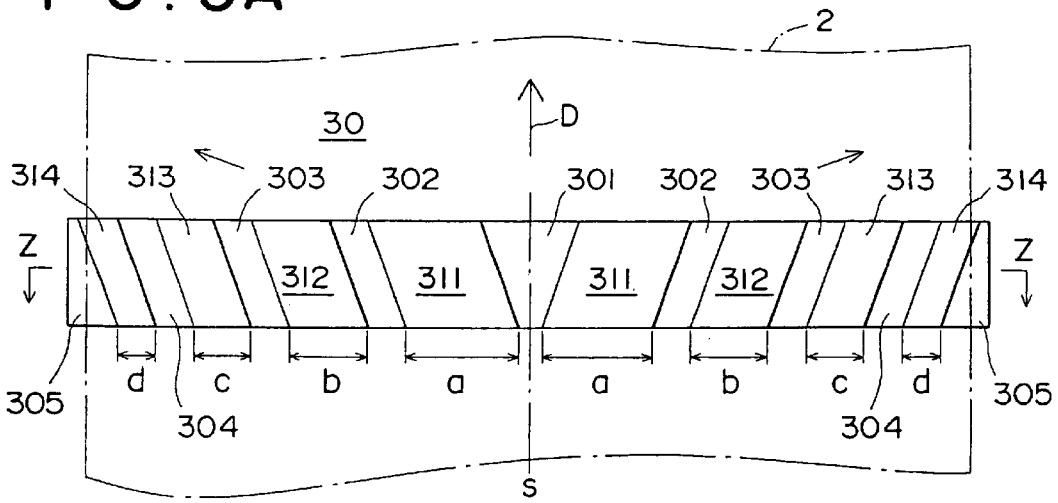
FIG. 5A is a bottom view of still another example of the tension blade.
Figure 5B:
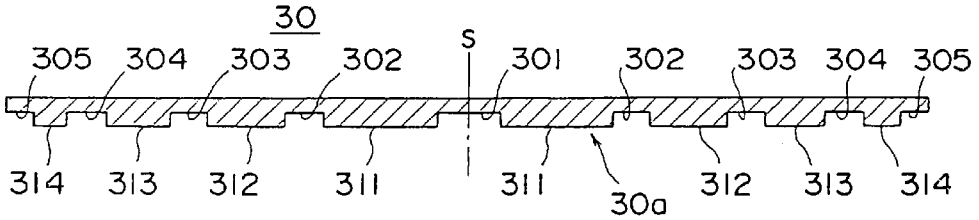
FIG. 5B is a cross-sectional view taken along line Z—Z in FIG. 5A.

Still another example of the tension blade 10 will be described with reference to FIGS. 5A and 5B, hereinbelow.

The tension blade 30 of this example differs from the preceding tension blades 10 and 20 in the shape and arrangement of the grooves formed on the outer surface 30*a* at which the tension blade 30 is brought into contact with the stencil 2.

That is, in this example, the central groove 301 is formed at the center of the tension blade 30 so that the center line of the central groove 301 conforms to the longitudinal axis s of the stencil 2 and three grooves 302 to 304 substantially of the same width are formed on each side of the central groove 301 so that the spaces therebetween are gradually narrowed outward. The central groove 301 is of a trapezoid in shape flaring toward the downstream of the direction of conveyance of the stencil 2, and the grooves 302 to 304 extend obliquely outward toward the downstream of the direction of conveyance of the stencil 2 at a predetermined angle to the direction of conveyance in parallel to each other. An edge groove 305 is formed outside the groove 304. That is, contact lands 311 to 314 are formed between the grooves 301 to 305 and the widths a to d of the contact lands 311 to 314 become smaller in this order. (a>b>c>d)

When the tension blade 30 with this arrangement is brought into contact with the stencil 2, the contact resistance is maximum at the center of the stencil and becomes smaller toward the outer edges of the stencil 2, and the contact points between the tension blade 30 and the stencil 2 are shifted from the central portion toward the side edges of the stencil in parallel to the direction of the grooves 302 to 305 as the stencil 2 slides on the tension blade 30 in the direction D of conveyance of the stencil 2, whereby outward frictional resistance acts on the stencil 2. As a result, the central portion of the stencil 2 is expanded and the stencil 2 undergoes force which tends to displace the stencil 2 from the central portion toward the side edges of the stencil 2, whereby slack, which can result in longitudinal wrinkle of the stencil 2, cannot be generated in the central portion. Further, since the shape of the contact surface 30*a* of the tension blade 30 is symmetrical, the stencil 2 is not obliquely run and accordingly, the stencil 2 can be evenly wound around the printing drum 3 in a correct position.

The surface of the tension blade to be brought into contact with the stencil may be formed so that the contact area of the tension blade with the stencil is smaller at the outer portion than at the central portion of the stencil by changing the width of the grooves instead of changing the width of the lands between the grooves. Further, the grooves may be formed on only the part to be actually brought into contact with the stencil 2. FIGS. 3A to 5B simply show examples of the shape of the grooves and arrangements of the same, and the number of the grooves, inclination of the grooves and the like maybe suitably changed.

What is claimed is;

1. A stencil printer system in which a stencil is made by the use of master material unrolled from a stencil material roll and is wound around a printing drum by clamping the leading end of the stencil on the printing drum and rotating the printing drum while the stencil is once slackened on the way to the printing drum, wherein the improvement comprises that there is provided along the stencil conveyance path between the stencil material roll and the printing drum a tension blade which is pressed against the stencil to apply back tension to the stencil when the stencil is run by the printing drum and the tension blade is formed so that the stencil undergoes force which tends to displace outward the stencil from the central portion in the direction of width of the stencil.

2. A stencil printer system as defined in claim 1 in which the tension blade is formed so that the stencil undergoes force which tends to displace outward the stencil from the central portion in the direction of width of the stencil by forming grooves on the surface of the tension blade to be brought into contact with the stencil so that the contact area of the tension blade with the stencil is smaller at the outer portion than at the central portion of the stencil.

3. A stencil printer system as defined in claim 1 in which the tension blade is formed so that the stencil undergoes force which tends to displace outward the stencil from the central portion in the direction of width of the stencil by forming grooves on the surface of the tension blade to be brought into contact with the stencil to extend obliquely outward forward of the direction of conveyance of the stencil.

4. A stencil printer system as defined in claim 1 in which the tension blade is symmetrical with respect to the longitudinal axis of the stencil.

* * * * *